US006739670B2

(12) United States Patent
Johnson

(10) Patent No.: US 6,739,670 B2
(45) Date of Patent: May 25, 2004

(54) ADJUSTABLE HEIGHT TABLE HAVING MULTIPLE CHAIRS/OTTOMANS WITH STORAGE AND METHOD THEREFOR

(76) Inventor: Edward H. Johnson, 9761 E. Pinnacle Vista Dr., Scottsdale, AZ (US) 85255

( * ) Notice: Subject to any disclaimer, the term of this patent is extended or adjusted under 35 U.S.C. 154(b) by 0 days.

(21) Appl. No.: 10/225,508

(22) Filed: Aug. 21, 2002

(65) Prior Publication Data

US 2004/0036324 A1 Feb. 26, 2004

(51) Int. Cl.[7] ..... A47C 16/00

(52) U.S. Cl. ..... 297/423.41; 297/135; 297/217.1; 297/188.15; 108/147

(58) Field of Search ..... 297/344.18, 423.45, 297/423.44, 188.08, 188.13, 188.09, 188.1, 423.41, 440.1, 217.1, 135, 423.39, 463.2, 119, 118, 121, 129, 140, 158.1, 158.2, 158.5, 344.21, 344.26, 353, 124; 108/50.11, 50.14, 59, 60, 64, 66, 157.1, 185, 147; 29/428

(56) References Cited

U.S. PATENT DOCUMENTS 557,067 A * 3/1896 Geismsn ..... 297/188.1
621,746 A * 6/1899 Brandt ..... 108/25
1,832,642 A * 11/1931 Leff ..... 297/188.1
2,145,201 A * 1/1939 Raeuber ..... 297/142
2,430,241 A * 11/1947 Nicholas ..... 312/210
2,606,599 A * 8/1952 Santasuosso ..... 297/188.1
2,658,640 A * 11/1953 Bayles ..... 217/5
2,765,025 A * 10/1956 Bakalic et al. ..... 297/188.08
3,083,052 A * 3/1963 Thorson ..... 297/140
3,213,467 A * 10/1965 Hubbard ..... 4/478
3,706,471 A * 12/1972 Shimosawa ..... 297/158.1
3,746,391 A * 7/1973 Novak ..... 297/188.1
3,932,009 A * 1/1976 Zollinger ..... 312/312
4,334,482 A * 6/1982 Bolduc ..... 108/95
4,366,998 A * 1/1983 Kaiser ..... 312/235.1
4,883,317 A * 11/1989 Davenport ..... 297/188.1
5,335,962 A * 8/1994 Gera ..... 297/232
5,462,248 A * 10/1995 Bauer ..... 248/161
5,749,557 A * 5/1998 Chang ..... 248/405
5,992,815 A * 11/1999 Metzdorf et al. ..... 248/631
6,010,185 A * 1/2000 Petersen ..... 297/158.3
6,045,193 A * 4/2000 Johnson ..... 297/423.41
6,182,583 B1 * 2/2001 Larson ..... 108/147
6,267,337 B1 * 7/2001 Kulhavy ..... 248/161
6,390,551 B1 * 5/2002 Hendrickson ..... 297/250.1
6,435,970 B1 * 8/2002 Baerlocher et al. ..... 463/46
D471,035 S * 3/2003 Schwanke et al. ..... D6/486

* cited by examiner

*Primary Examiner*—Anthony D. Barfield
*Assistant Examiner*—Stephanie Harris
(74) *Attorney, Agent, or Firm*—Jeffrey D. Moy; Harry M. Weiss; Weiss, Moy & Harris, P.C.

(57) ABSTRACT

A combination chair/ottoman and table assembly has a plurality of chairs/ottomans adapted to be alternatively positioned adjacent to one another and separated from one another. Each of the plurality of chairs/ottomans has a hollow interior section for storing items. A finished table surface is positioned at a top portion of each of the plurality of chairs/ottomans. A positioning member is adapted to position each of the plurality of chairs/ottomans adjacent to another of the plurality of chairs/ottomans. A "Lazy Susan" is located substantially at a middle portion of the positioning member.

16 Claims, 3 Drawing Sheets

ADJUSTABLE HEIGHT TABLE HAVING MULTIPLE CHAIRS/OTTOMANS WITH STORAGE AND METHOD THEREFOR

RELATED APPLICATIONS

This patent application is related to U.S. Pat. No. 6,045,193 issued on Apr. 4, 2000, in the name of Edward H. Johnson, and entitled "COMBINATION MULTIPLE OTTOMANS AND COFFEE TABLE AND METHOD THEREFOR". The above mentioned patent is hereby incorporated into the present patent application.

BACKGROUND OF THE INVENTION

1. Field of the Invention

This invention relates generally to household furniture and, more specifically, to a furniture item that can be converted from a plurality of individually-functioning chairs/ottomans to a combined adjustable height table with chairs/ottoman having storage space and method therefor.

2. Description of the Prior Art

Presently, most furniture is designed for a single purpose. Most all furniture is designed to perform one main function and cannot be changed or altered to allow the furniture to perform a different function or task.

Ottomans and coffee tables are typical features of the modern living room. Of course, the ottoman is useful as a support for the feet and legs of a person sitting in close proximity thereto. The coffee table, on the other hand, may be used to hold decorative objects or food and drinks. It is noted herein, as is known to those skilled in the art, that even though the term coffee table is used throughout this application, coffee tables also serve as and are interchangeable with end tables, snack tables, etc. which may be located in front of or to the side of a user. The problem with the above furniture is that most chairs/ottomans cannot be used for any other purpose. Furthermore, most coffee tables can not be altered to perform other functions.

Therefore, a need existed to provide furniture which overcomes the problems associated with prior art furniture and which can be used for multiple purposes/functions.

SUMMARY OF THE INVENTION

In accordance with one embodiment of the present invention, it is an object of the present invention to provide an improved piece of furniture.

It is another object of the present invention to provide furniture which overcomes the problems associated with prior art furniture and which can be used for multiple purposes/functions.

BRIEF DESCRIPTION OF THE EMBODIMENTS

In accordance with one embodiment of the present invention, a combination chair/ottoman and table assembly is disclosed. The combination chair/ottoman and table assembly has a plurality of chairs/ottomans adapted to be alternatively positioned adjacent to one another and separated from one another. Each of the plurality of chairs/ottomans has a hollow interior section for storing items. A finished table surface is positioned at a top portion of each of the plurality of chairs/ottomans. A positioning member is adapted to position each of the plurality of chairs/ottomans adjacent to another of the plurality of chairs/ottomans. A "Lazy Susan" is located substantially at a middle portion of the positioning member.

In accordance with another embodiment of the present invention, a combination chair/ottoman and table assembly is disclosed. The combination chair/ottoman and table assembly has a plurality of chairs/ottomans adapted to be alternatively positioned adjacent to one another and separated from one another. Each of the plurality of chairs/ottomans has a hollow interior section for storing items. A finished table surface is positioned at a top portion of each of the plurality of chairs/ottomans. A positioning member is adapted to position each of the plurality of chairs/ottomans adjacent to another of the plurality of chairs/ottomans. A "Lazy Susan" is located substantially at a middle portion of the positioning member. A covering table surface dimensioned to be removably positioned upon the "Lazy Susan" so that the covering table surface may be rotated. A lifting mechanism is located withing the positioning member for raising and lowering a height of the "Lazy Susan" and the covering table surface.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENT

Figure 1:
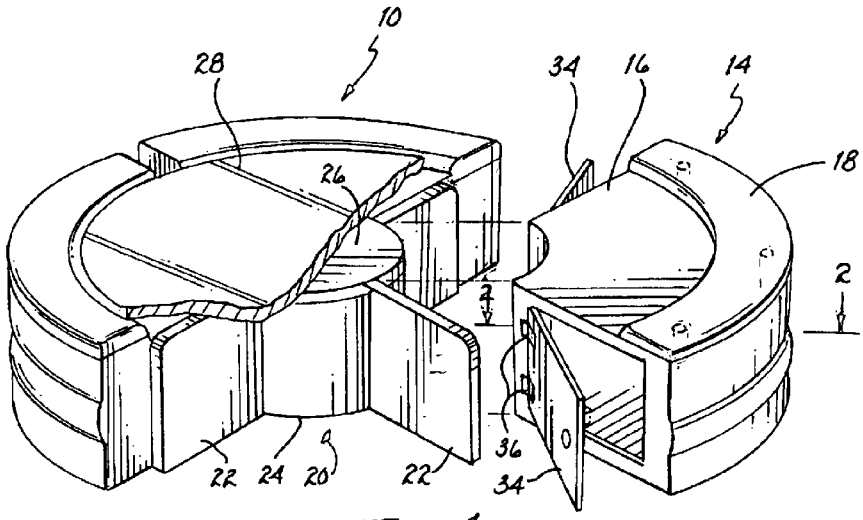
FIG. 1 is an elevated perspective view of an adjustable height table with chairs/ottomans with one chair/ottoman removed.
Figure 2:
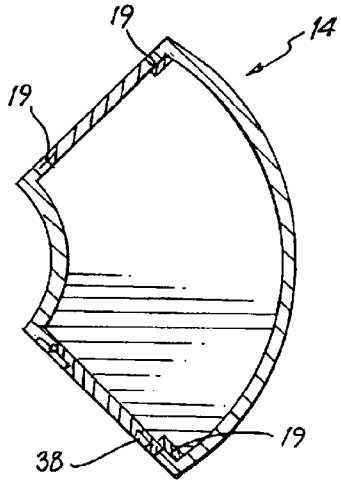
FIG. 2 is a bottom view of a single chair/ottoman.
Figure 3:
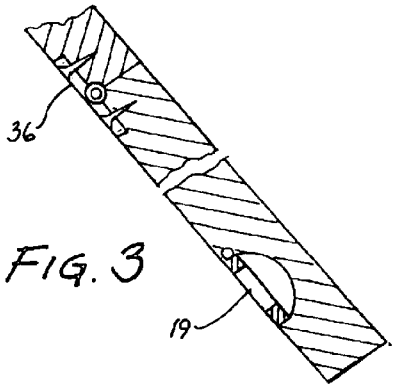
FIG. 3 is a close-up top view of the door assembly used in the chair/ottoman.

Referring to FIGS. 1–6 wherein like numerals and symbols represent like elements a combination table and chair/ottoman assembly 10 (hereinafter assembly 10) is shown. The assembly 10 is comprised of an adjustable height table 12 and a plurality of component chairs/ottomans 14. In accordance with one embodiment of the present invention, the assembly 10 comprises four individual component chairs/ottomans 14. As shown in FIGS. 1–3, the component chairs/ottomans 14 are substantially quadrant-shaped, so that together the component chairs/ottomans 14 form a circle when placed adjacent to one another. However, without departing from the spirit or scope of this invention, other geometrical configurations for the component chair/ottomans 14, the adjustable height table 12, and the fully assembled combination table chair/ottoman assembly 10 are possible. Moreover, while the embodiment in the Figures depict the assembly 10 having four component chairs/ ottomans 14, a smaller (as few as two) or larger number of component chairs/ottomans 14 may also be provided.

Figure 4:
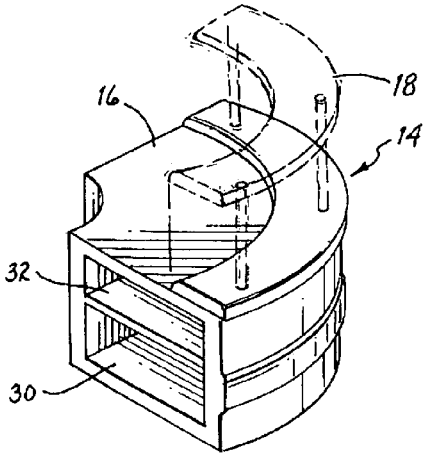
FIG. 4 is a side view of the chair/ottoman with the door assembly removed.

Referring to FIGS. 1–4, each component chair/ottoman 14 comprises on a portion of its upper surface a finished table surface 16. The finished table surface 16 may be made out of any of the types of material that is typically used in the manufacture of dining tables, coffee tables, end tables, snack tables, etc. Adjacent the finished table surface, around the periphery of the upper surface of each component chair/ottoman 14 is a cushioned area 18. The cushioned area 18 is designed to allow an individual to comfortably rest ones arms, legs, or the like on the component chair/ottoman 14. The cushioned area 18 will receive the arms, feet, etc. of a user (not shown) when the component chair/ottoman 14 is in use as an ottoman thus enabling the use of each component chair/ottoman 14 as both an ottoman and/or a coffee/snack/end table. The cushioned area 18 may be covered with leather or vinyl or any other covering material typically used in the manufacture of furniture. The cushioned area 18 may also be raised. If the chair/ottoman 14 is to function as a chair, one may raise the cushioned area 18 as shown in FIG. 4. This will transpose the cushioned area 18 into a back rest. The presence of the finished table surface 16 and the cushioned area 18 makes each component chair/ottoman 14, itself, an individual combination coffee table and ottoman. Furthermore, those skilled in the art will recognize that even though the term coffee table is used herein, the component chair/ottoman 12 of the present invention may also serve as any type of table such as an end table, a snack table, etc. any of which are in keeping with the scope and spirit of the present invention.

Each component chair/ottoman 14 has located on a bottom surface thereof a plurality of rollers 20. The rollers 20 will allow one to easily move the component chair/ottoman 14. Thus, the rollers 20 permit the ready deployment of a component chair/ottoman 14 for individual use as either or both of an ottoman or a table, either in front of or to the side of the user, as well as its return to the configuration shown in FIG. 1 in combination with the other component chairs/ottomans 14.

The component chair/ottoman 14 will also function as an area to store items. The component chair/ottoman 14 may have a hollow section 30 located internal to the component chair/ottoman 14. The hollow section 30 may be used to store and house items within the component chair/ottoman 14. Shelving 32 may further be located within the hollow section 30. The shelving 32 would be used to help arrange items within the storage area 30. In order to access the hollow section 30, one or more doors 34 may be coupled to each end of the component chair/ottoman 14. Alternatively, the hollow section 30 may remain open. If doors 34 are used, the doors 34 are coupled to each end of the component chair/ottoman 14 by using one or more hinges 36. It should be noted that only a single door 34 may be used on the component chair/ottoman 14 with the other end of the component chair/ottoman 14 being enclosed, or doors 34 may be located on each end of the hollow section 30. A locking mechanism 38 may be used to secure the door 34 in a closed position. Any type of locking mechanism 38 may be used. For example, a simple set of magnets may be used as a locking mechanism. It should be noted that the above is just given as an example and should not be seen as to limit he scope of the present invention.

Figure 5:
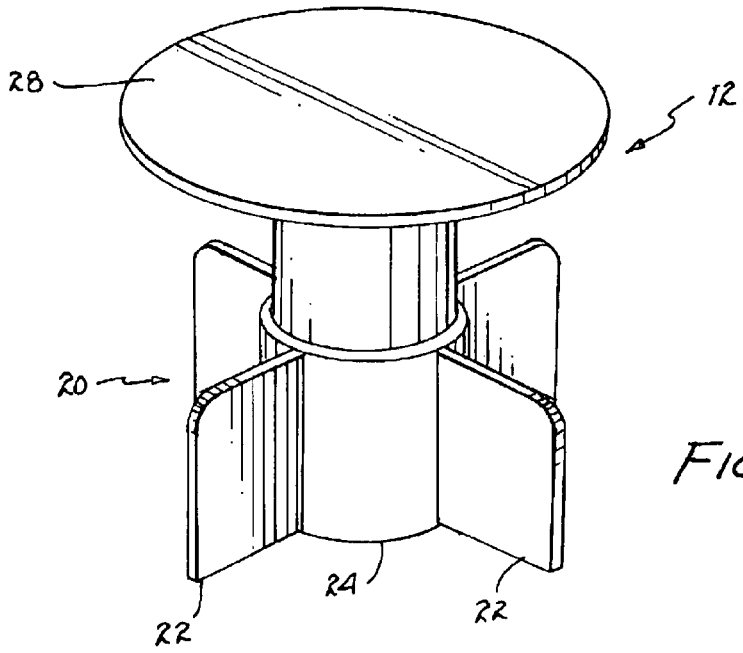
FIG. 5 is a perspective view of the adjustable height table.

Referring now to FIGS. 1 and 5, the assembly 10 has a positioning member 20. The positioning member 20 contains a plurality of arms 22 which extend from a center area 24. The arms 22 and center area 24 define spaces into which each component chair/ottoman 14 should be placed when the assembly 10 is fully assembled. The center area 24 may include, at a top surface thereof, a "Lazy Susan" 26 which rotates about the top of the center area 24. A covering table 28 may be positioned upon the "Lazy Susan" 26, so as to cover the "Lazy Susan" 26 and each of the finished table surfaces 14—though not the cushioned areas 16 (See FIG. 1). In this manner, when the assembly 10 is fully assembled, the cushioned areas 18 may be used as foot/leg rests while, at the same time, the covering table 28—which may be rotated upon the "Lazy Susan" 26, for example as an aid to food service—may be used as a coffee table, snack table, end table, etc.

Figure 6:
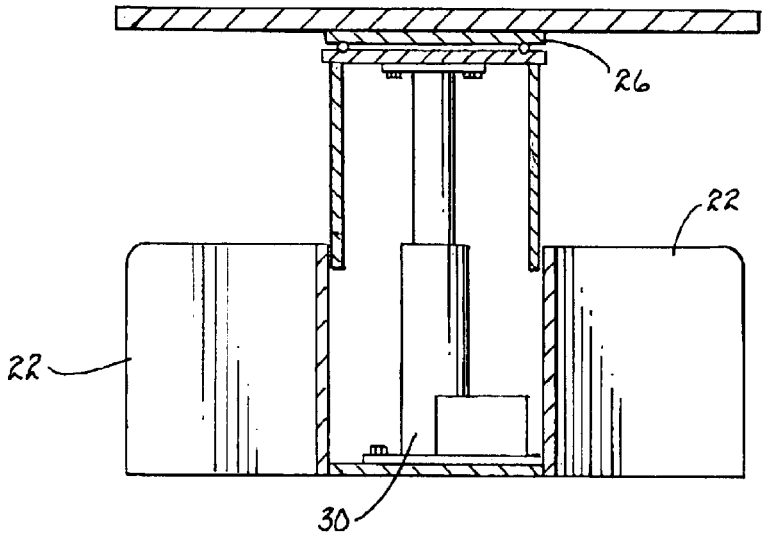
FIG. 6 is a cross-sectional view of the adjustable height table.

Referring now to FIGS. 5 and 6, located within the center area 24 is a lift mechanism 30. The lifting mechanism 30 is used to raise and lower the covering table 28 and the "Lazy Susan" 26. Thus, the lifting mechanism 30 may raise the table 12 so that the table 12 may be used more for dining. Thus, the component chair/ottoman 14 could be used for sitting around the raised table 12. Any type of lifting mechanism 30 may be used. The lifting mechanism 30 may be a hydraulic lift, pneumatic lift, motor driven, hand cranked or the like. The listing of the above lifting devices 30 are only given as examples and should not be seen as to limit the scope of the present invention.

Figure 7:
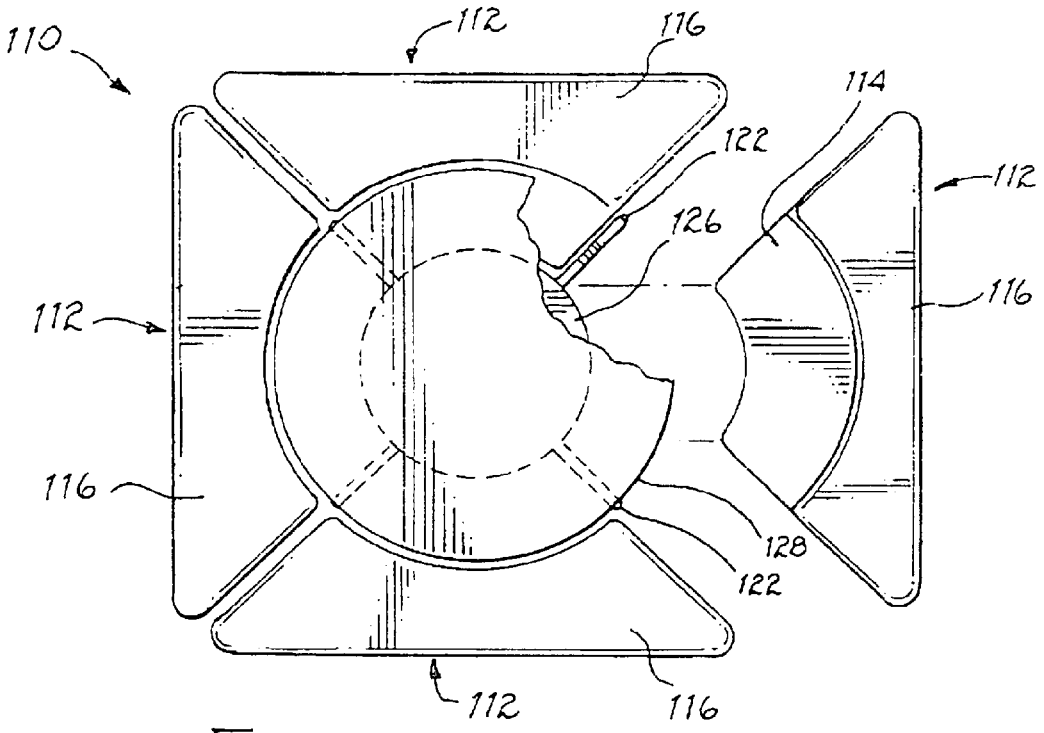
FIG. 7 is a top view of an alternative embodiment of the adjustable height table with chairs and ottomans.
Figure 8:
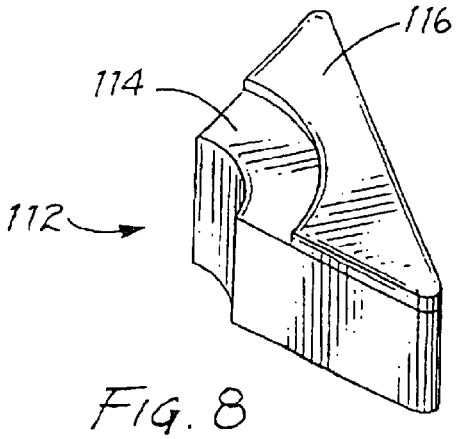
FIG. 8 is a elevated perspective view of the component ottoman.

Referring to FIGS. 7 and 8, an alternate embodiment of the present invention is shown. Reference number 110 refers generally to the combination table and chair/ottoman assembly (hereinafter assembly 110). The assembly 110 comprises four individual component chairs/ottomans 112. As shown in FIGS. 7 and 8, the component chairs/ottomans 112 are preferably substantially triangle-shaped, similar to the previous embodiment, except that herein, they together form an essentially square shape when placed adjacent to one another as shown in FIG. 7. As mentioned in the prior discussion concerning a round embodiment, this alternate embodiment is an additional geometrical configuration of the present invention. While in an alternate embodiment the assembly 110 comprises four component ottomans 112, a smaller (as few as two) or larger number of component ottomans, 112 may also be provided, and the component ottoman 112 may have other than a substantially triangle-shaped configuration.

Each component chair/ottoman 112 comprises on a portion of its upper surface a finished table surface 114, made of any of the types of material that is typically used in the manufacture of coffee tables. Adjacent the finished table surface, around the periphery of the upper surface of each component chair/ottoman 112 is a cushioned area 116, which is designed to receive the feet, arm, or other body part of a user (not shown). The cushioned area 116 may be covered with leather or vinyl or any other covering material typically used in the manufacture of furniture. The presence of the finished table surface 114 and the cushioned area 116 makes each component chair/ottoman 112, itself, an individual combination coffee table and ottoman. Furthermore, those skilled in the art will recognize that even though the term coffee table is used herein, the component chair/ottoman 112 of the present invention also serves as an end table, a snack table, etc. any of which are in keeping with the scope and spirit of the present invention.

Though not explicitly shown in FIGS. 7 and 8, each component chair/ottoman 112 of the alternative embodiment has located on a bottom surface thereof a plurality of rollers so as to permit the ready deployment of a component chair/ottoman 112 for individual use as either or both of an ottoman or a coffee/snack/end table, as well as its return to the configuration shown in FIG. 7 in combination with the other component chairs/ottomans 112.

Though not explicitly shown in FIGS. 7 and 8, each component chair/ottoman 112 of the alternative embodiment has will also function as an area to store items. The component chair/ottoman 112 may have a hollow section located internal to the component chair/ottoman 112. The hollow section may be used to store and house items within the component chair/ottoman 112. Shelving may further be located within the hollow section. The shelving would be used to help arrange items within the storage area 30. In order to access the hollow section, one or more doors are coupled to each end of the component chair/ottoman 112. The doors are coupled to each end of the component chair/ottoman 14 by using one or more hinges. It should be noted that only a single door may be used on the component chair/ottoman 112 with the other end of the component chair/ottoman 112 being enclosed. A locking mechanism may be used to secure the door in a closed position. Any type of locking mechanism may be used. For example, a simple set of magnets may be used as a locking mechanism. It should be noted that the above is just given as an example and should not be seen as to limit he scope of the present invention.

The assembly 110 further comprises a positioning member 20 as shown in FIGS. 1 and 5. The positioning member 20 preferably contains arms 122 (FIG. 7), extending from a center area 24 (FIGS. 1 and 5) in which arms 122 and center area 24 define the space into which each component chair/ottoman 112 should be placed when the assembly 110 is fully assembled. The center area 24 should include, at a top surface thereof, a "Lazy Susan" 126 which rotates about the top of the center area 24. In an alternative embodiment, a covering table 128 may be positioned upon the "Lazy Susan" 126, so as to cover the "Lazy Susan" 126 and each of the finished table surfaces 114—though not the cushioned areas 116. In this manner, when the assembly 110 is fully assembled, the cushioned areas 116 may be used as rest areas while, at the same time, the covering table 128—which may be rotated upon the "Lazy Susan" 126, for example as an aid to food service—may be used as a coffee table, end table, snack table, etc.

Located within the center area 24 is a lift mechanism similar to that shown in FIGS. 5 and 6. The lifting mechanism is used to raise and lower the covering table 128 and the "Lazy Susan" 126. Thus, the lifting mechanism may raise the table so that the table may be used more for dining. Thus, the component chair/ottoman 112 could be used for sitting around the raised table. Any type of lifting mechanism may be used. The lifting mechanism may be pneumatic, motor driven, hand cranked or the like. The listing of the above lifting devices are only given as examples and should not be seen as to limit the scope of the present invention.

As may be observed from the above discussion and FIGS. 1–8, the center area 24 as substantially identical for both a preferred embodiment and an alternative embodiment. The essential differences are the outer perimeter shape of each component ottoman 12 and 112. Therefore, not explicitly shown herein, it will be understood that the component ottoman 12 and 112 are in fact interchangeable and mixable. For example, an additional alternative embodiment could have two of the rounded component ottoman 12s, and two of the squared off component ottoman 112s, or any combination thereof. Thus, utilizing a standard center area 24 as shown in FIGS. 1 and 5, and a variable combination of differently geometrically shaped component ottomans 12, 112, etc. allows substantial diversity within the present invention.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A combination chairs or ottomans and table assembly comprising, in combination:

a plurality of chairs or ottomans adapted to be alternatively positioned adjacent to one another and separated from one another wherein each of the plurality of chairs or ottomans has a hollow interior section for storing items, each of the chairs or ottomans further having a cushioned member to comfortably support body parts which may be rested on the chairs or ottomans, the cushioned member being movably coupled thereto so the cushioned section can be raised to form a back rest;

a finished table surface positioned at a top portion of each of the plurality of chairs or ottomans;

a positioning member adapted to position each of the plurality of chairs or ottomans adjacent to another of the plurality of chairs or ottomans; and a "Lazy Susan" located substantially at a middle portion of the positioning member.

2. A combination chairs or ottomans and table assembly in accordance with claim 1 further comprising a covering table surface dimensioned to be removably positioned upon the "Lazy Susan" so that the covering table surface may be rotated.

3. A combination chairs or ottomans and table assembly in accordance with claim 1 further comprising a door coupled to each of the plurality of chairs or ottomans for closing the hollow interior section.

4. A combination chairs or ottomans and table assembly in accordance with claim 1 further comprising a pair of doors coupled to each end of each of the plurality of chairs or ottomans for closing the hollow interior section of each of the plurality of chairs or ottomans.

5. A combination chairs or ottomans and table assembly in accordance with claim 3 further comprising a locking mechanism coupled to each door and to each of the plurality of chairs or ottomans for securing the door in a locked position.

6. A combination chairs or ottomans and table assembly in accordance with claim 4 further comprising a locking mechanism coupled to each door and to each of the plurality of chairs or ottomans for securing the door in a locked position.

7. A combination chairs or ottomans and table assembly in accordance with claim 1 further comprising a lifting mechanism located within the positioning member for raising and lowering a height of the "Lazy Susan".

8. A combination chairs or ottomans and table assembly in accordance with claim 2 further comprising a lifting mechanism located within the positioning member for raising and lowering a height of the covering table surface and the "Lazy Susan".

9. A combination chairs or ottomans and table assembly in accordance with claim 1 wherein the finished table surface is an integral portion of each of the plurality of chairs or ottomans.

10. A combination chairs or ottomans and table assembly in accordance with claim 1 wherein each of the chair or ottoman is substantially quadrant-shaped, so that when the chairs or ottomans are positioned adjacent to one another a circle shape is formed.

11. A combination chairs or ottomans and table assembly in accordance with claim 1 wherein each of the chair or ottoman is substantially triangle-shaped, so that when the chairs or ottomans are positioned adjacent to one another a square shape is formed.

12. A combination chairs or ottomans and table assembly comprising, in combination:

a plurality of chairs or ottomans adapted to be alternatively positioned adjacent to one another and separated from one another wherein each of the plurality of chairs or ottomans has a hollow interior section for storing items, each of the chairs or ottomans further having a cushioned member to comfortably support body parts which may be rested on the chairs or ottomans, the cushioned member being movably coupled thereto so the cushioned section can be raised to form a back rest;

a finished table surface positioned at a top portion of each of the plurality of chairs or ottomans;

a positioning member adapted to position each of the plurality of chairs or ottomans adjacent to another of the plurality of chairs or ottomans;

a "Lazy Susan" located substantially at a middle portion of the positioning member;

a covering table surface dimensioned to be removably positioned upon the "Lazy Susan" so that the covering table surface may be rotated; and a lifting mechanism located within the positioning member for raising and lowering a height of the "Lazy Susan" and the covering table surface.

13. A combination chairs or ottomans and table assembly in accordance with claim 12 further comprising a door coupled to each of the plurality of chairs or ottomans for closing the hollow interior section.

14. A combination chairs or ottomans and table assembly in accordance with claim 13 further comprising a pair of doors coupled to each end of each of the plurality of chairs or ottomans for closing the hollow interior section of each of the plurality of chairs or ottomans.

15. A combination chairs or ottomans and table assembly in accordance with claim 13 further comprising a locking mechanism coupled to each door and to each of the plurality of chairs or ottomans for securing the door in a locked position.

16. A combination chairs or ottomans and table assembly in accordance with claim 14 further comprising a locking mechanism coupled to each door and to each of the plurality of chairs or ottomans for securing the door in a locked position.

* * * * *